US008390202B2

(12) United States Patent
Chuang et al.

(10) Patent No.: US 8,390,202 B2
(45) Date of Patent: Mar. 5, 2013

(54) EXTERNAL ELECTRICAL-CONTROL LAMP WITH IMPROVED STRUCTURE

(75) Inventors: Shih-Jen Chuang, Sindien (TW); Chun-Yi Tsai, Sindien (TW)

(73) Assignee: Ecolighting, Inc. Corp., New Taipei (TW)

( * ) Notice: Subject to any disclaimer, the term of this patent is extended or adjusted under 35 U.S.C. 154(b) by 316 days.

(21) Appl. No.: 12/981,442

(22) Filed: Dec. 29, 2010

(65) Prior Publication Data

US 2012/0169228 A1 Jul. 5, 2012

(30) Foreign Application Priority Data

Apr. 9, 2010 (TW) ..... 99206255 U

(51) Int. Cl.
*H05B 37/00* (2006.01)

(52) U.S. Cl. ..... 315/51; 315/52; 315/247; 315/291

(58) Field of Classification Search ..... 315/51, 315/57, 56, 59, 52, 53, 54, 291, DIG. 4, 247, 315/307, 308, 74, 70, 71, 246
See application file for complete search history.

(56) References Cited

U.S. PATENT DOCUMENTS

| | | | | |
|---|---|---|---|---|
| 5,982,111 | A * | 11/1999 | Moisin | 315/283 |
| 6,181,086 | B1 * | 1/2001 | Katyl et al. | 315/307 |
| 2008/0122364 | A1 * | 5/2008 | McClellan | 315/51 |
| 2010/0033095 | A1 * | 2/2010 | Sadwick | 315/51 |
| 2011/0043137 | A1 * | 2/2011 | Negley et al. | 315/297 |

* cited by examiner

*Primary Examiner* — David H Vu
(74) *Attorney, Agent, or Firm* — Chun-Ming Shih; HDLS IPR Services

(57) ABSTRACT

An external electrical-control lamp with improved structure includes a light-emitting diode lamp (1), an external power box (2), and a dimmer (4). The light-emitting diode lamp (1) has a circuit board (11), at least one light-emitting diode (12), a thermal module (13), and a rectifying circuit (14). The light-emitting diode (12) is installed on the circuit board (11), the thermal module (13) provides a heat-dissipating function to the light-emitting diode (12), and the rectifying circuit (14) provides a rectified power to the light-emitting diode (12). When a utility power (3) is supplied to the dimmer (4) and the external power box (2), a variable resistor of the dimmer (4) is adjusted and the utility power (3) is controlled by the external power box (2), thus adjusting the brightness of the light-emitting diode (12).

8 Claims, 5 Drawing Sheets

EXTERNAL ELECTRICAL-CONTROL LAMP WITH IMPROVED STRUCTURE

BACKGROUND OF THE INVENTION

1. Field of the Invention

The present invention relates to a lamp structure, and more particularly to an external electrical-control lamp with improved structure that can provide an energy-saving operation, reduce temperature of electronic components, and increase product reliability.

2. Description of Prior Art

Early days, LEDs were used to indication or advertisement applications. With the tremendous development of science and technology, LEDs play a significant role in illumination, backlight, and display applications. Until the introduction of white LEDs, a major breakthrough in lighting applications occurs. Because LEDs present many advantages including lower energy consumption, longer lifetime, and maintenance free, the lamps of using LEDs are highly interested and popularized by world governments and companies.

Today, a light-emitting diode lamp integrated into the traditional halogen lamp is developed. Hence, the conventional connectors of the halogen lamp would not be discarded and the hot pluggable light-emitting diode lamp can directly replace the halogen lamp.

However, the integrated light-emitting diode has following disadvantages:

Because the light-emitting diode lamp has sharing connectors to the halogen lamp, the power control circuit of driving the light-emitting diodes has to be installed in the light-emitting diode lamp. It should also be added that the lighting efficiency of the existing light-emitting diode is relatively lower. Accordingly, when the light-emitting diodes are operated, much electrical consumption would be converted into heat energy. However, the high-temperature situation would significantly influence reliability and stability of the light-emitting diodes and other electronic components.

In addition, it is needs to discard the entire power control circuit or the light-emitting diode lamp when the power control circuit or the light-emitting diode lamp malfunctions. This would cause waste of the usable components to raise the issues of environmental protection.

SUMMARY OF THE INVENTION

In order to overcome the above-mentioned disadvantages, an external electrical-control lamp with improved structure is disclosed to provide an energy-saving operation, reduce temperature of electronic components, and increase product reliability.

In order to achieve the above-mentioned objectives, the external electrical-control lamp with improved structure includes a light-emitting diode lamp, an external power box and a dimmer. The light-emitting diode lamp has a circuit board, at least one light-emitting diode, a thermal module, and a rectifying circuit. The light-emitting diode is installed on the circuit board. The thermal module provides a heat-dissipating function to the light-emitting diode. The rectifying circuit provides a rectified power to the light-emitting diode.

The external power box has an AC-to-DC conversion circuit, a voltage/current feedback circuit, an isolated transformer, a constant-current output circuit, a power factor correction circuit, and a dimming control loop.

One end of the external power box is electrically connected to the rectifying circuit of the light-emitting diode lamp, thus providing electricity power to the light-emitting diode lamp.

In particular, the light-emitting diode lamp has light-emitting and heat-dissipating functions and the external power box can provide the require power for the light-emitting diode lamp. When the light-emitting diode lamp or the external power box malfunctions, it only needs to replace the light-emitting diode lamp or the external power box, that is, it does not need to discard the entire light-emitting diode module. This would avoid waste of the usable components to meet the requirements of environmental protection.

In general, when the power control circuit is integrated into light-emitting diode lamp, the higher temperature, which is produced from lighting the light-emitting diodes, would decrease the lifetime and reliability of the power control circuit because of volatilization of the electrolyte solution of electrolytic capacitors thereof. Hence, the interior temperature of the light-emitting diode lamp could effectively decrease when the external power box is used.

Furthermore, a rectifying circuit installed in the light-emitting diode lamp is provided to rectified power to the light-emitting diode. Hence, interior temperature of the light-emitting diode lamp could effectively decrease because of increasing interior space of the light-emitting diode lamp (without installing other electrical control components), thus increasing the lifetime and reliability thereof.

In addition, the value of the variable resistor of the dimmer can be adjusted to adjust the brightness of the light-emitting diode.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
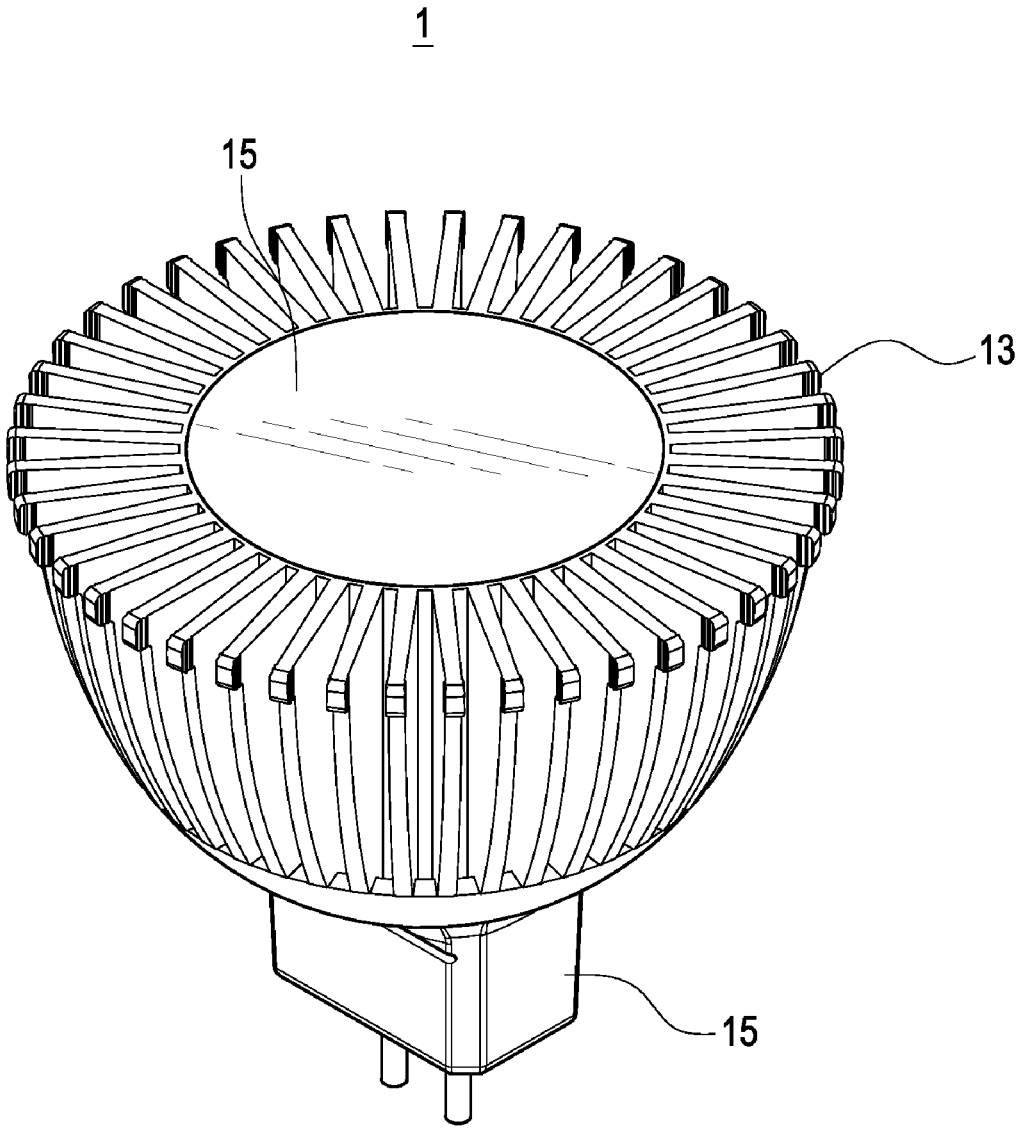
FIG. 1 is a perspective view of a preferred embodiment according to the present invention.

Reference will now be made to the drawing figures to describe the present invention in detail.

Figure 2:
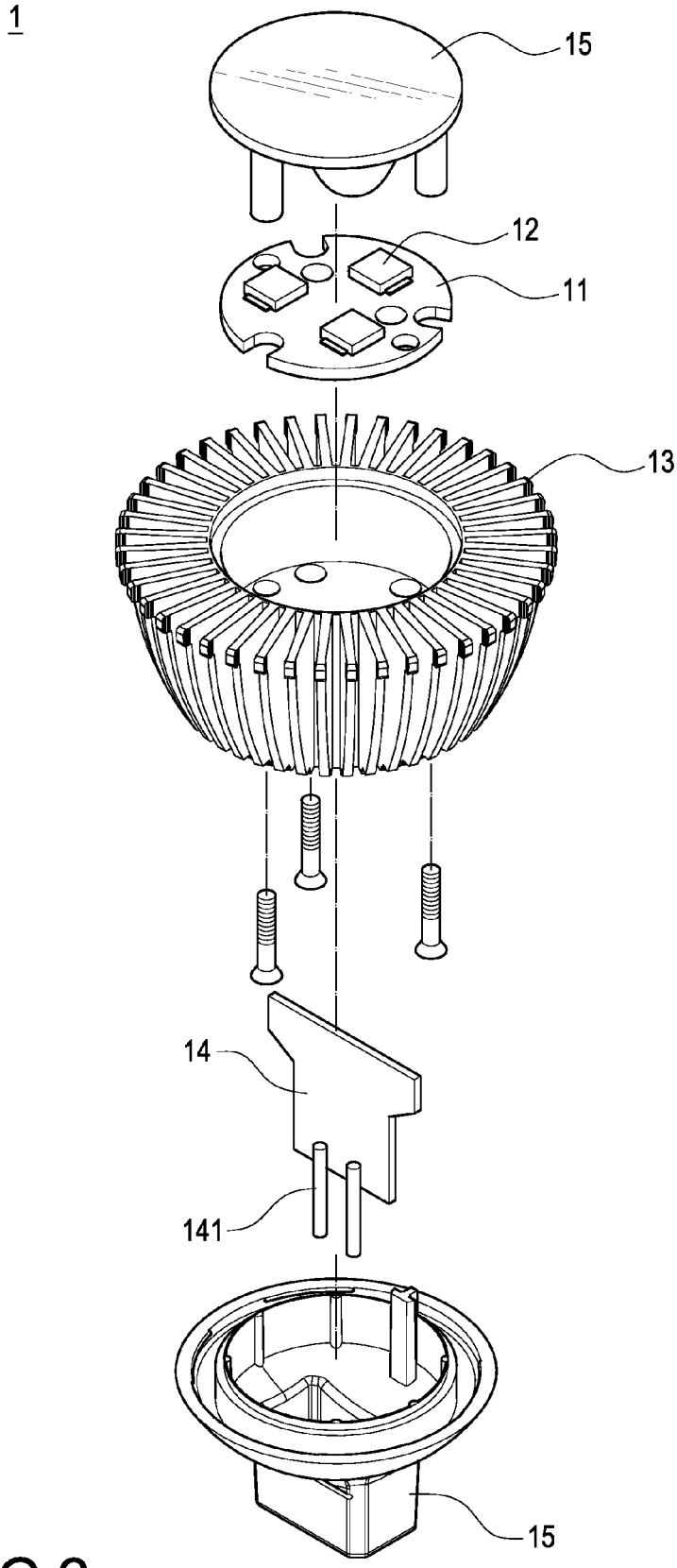
FIG. 2 is an exploded perspective view of the preferred embodiment.
Figure 3:
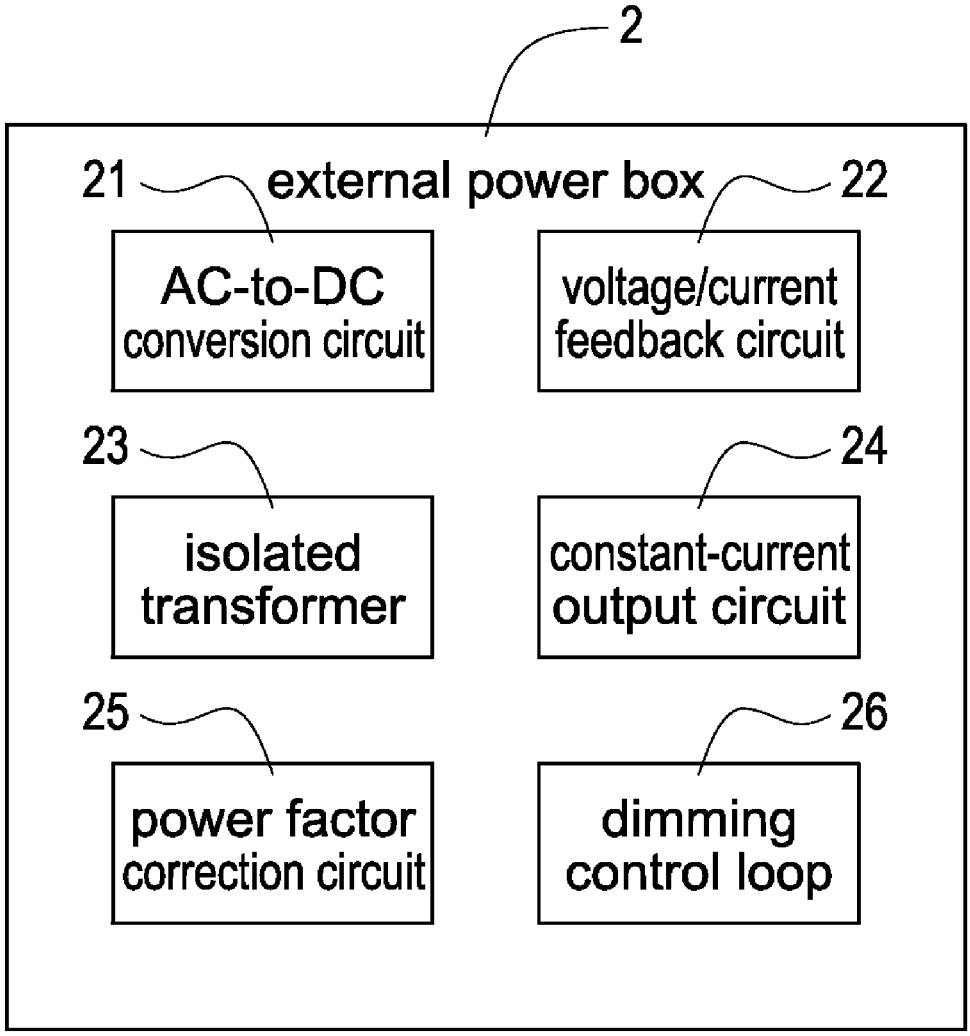
FIG. 3 is a block diagram of the preferred embodiment.

Reference is made to FIG. 1, FIG. 2, and FIG. 3 which are a perspective view, an exploded perspective view, and a block diagram of a preferred embodiment according to the present invention, respectively.

An external electrical-control lamp with improved structure includes a light-emitting diode lamp 1, an external power box 2, and a dimmer 4. The light-emitting diode lamp 1 has a circuit board 11, at least one light-emitting diode 12, a thermal module 13, a rectifying circuit 14, and a lamp housing 15.

The light-emitting diode 12 is installed on the circuit board 11. The thermal module 13 provides a heat-dissipating function to the light-emitting diode 12. The rectifying circuit 14 provides a rectified power to the light-emitting diode 12. In particular, the rectifying circuit 14 is a bridge diode rectifying circuit 14. In addition, the light-emitting diode lamp 1 is held on a lamp housing 15.

The dimmer 4 is electrically connected between the external power box 2 and the utility power 3 to adjust the brightness of the light-emitting diode 12. The dimmer 4 is a phase-control dimmer. That is, the dimmer 4 has a phase-control circuit (not shown) which is composed of a diode AC switch (DIAC) and a triode AC semiconductor switch (TRIAC). The operation of the phase-control circuit is described as follows. The DIAC is a trigger diode that conducts current only after its breakdown voltage has been reached momentarily. When this occurs, a pulse signal is produced. The pulse signal is provided to trigger the TRIAC to implement the phase-control dimming. The phase-control circuit further has a variable resistor. By adjusting the variable resistor, the conduction angles of the DIAC and the TRIAC are controlled to adjust the brightness of the light-emitting diode 12.

The external power box 2 has an AC-to-DC conversion circuit 21, a voltage/current feedback circuit 22, an isolated transformer 23, a constant-current output circuit 24, a power factor correction circuit 25, and a dimming control loop 26. In particular, one end of the external power box 2 is electrically connected to rectifying circuit 14 of the light-emitting diode lamp 1, thus providing electricity power to the light-emitting diode lamp 1. In particular, the rectifying circuit 14 has a pin 141, and the pin 141 is electrically connected to the external power box 2. The other end of the external power box 2 is electrically connected to one end of the dimmer 4.

Figure 4A:
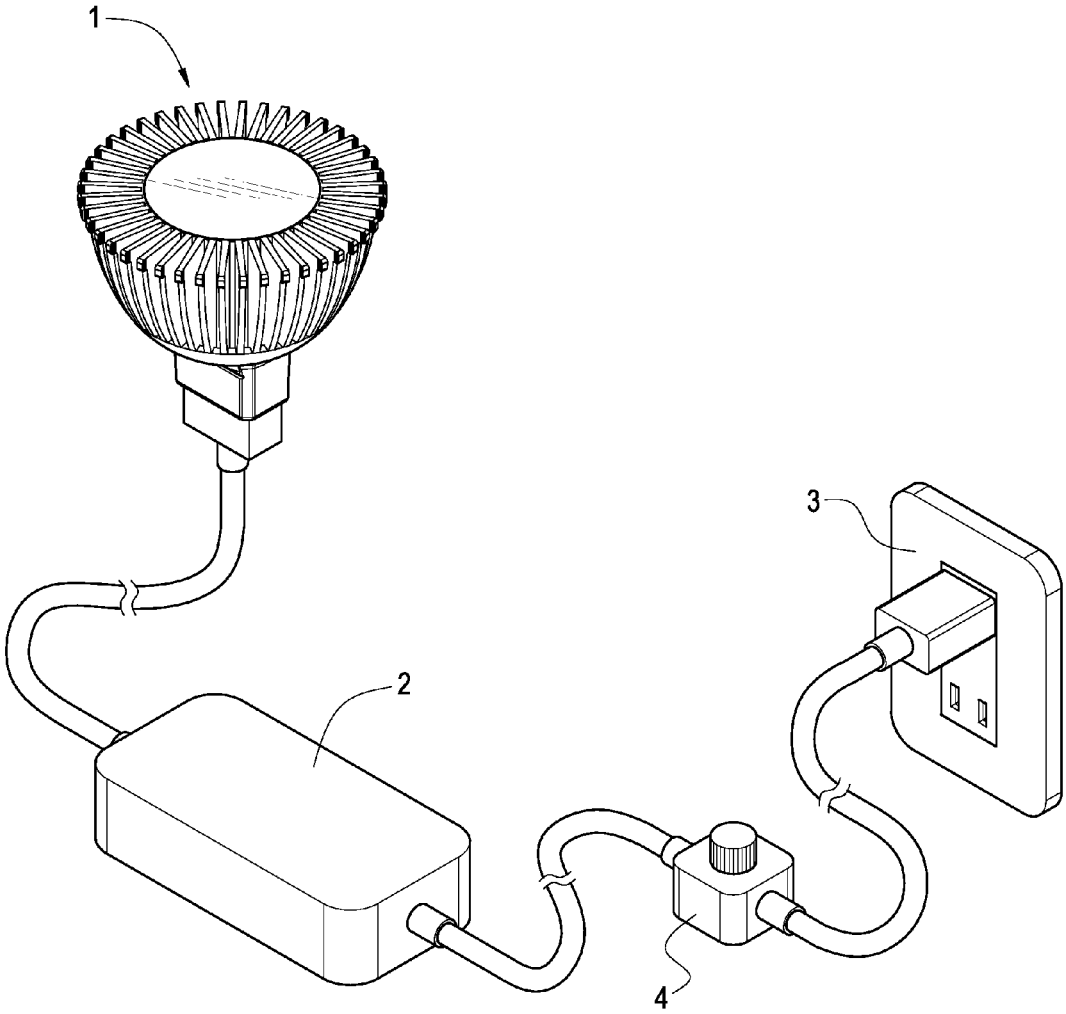
FIG. 4A is a schematic view of the preferred embodiment.

The detailed description of the external electrical-control lamp according to the above-mentioned structure and circuit design will be made as follows. Reference is further made to FIG. 4A which is a schematic view of the preferred embodiment. The external power box 2 has an AC-to-DC conversion circuit 21, a voltage/current feedback circuit 22, an isolated transformer 23, a constant-current output circuit 24, a power factor correction circuit 25, and a dimming control loop 26. In particular, the AC-to-DC conversion circuit 21, the voltage/current feedback circuit 22, the isolated transformer 23, the constant-current output circuit 24, the power factor correction circuit 25, and the dimming control loop 26 are properly electrically connected to each other, thus providing electrical functions. The utility power 3 is delivered to the external power box 2 through the dimmer 4. The dimmer 4 delivers the utility power 3 to one end of the external power box 2, and then the utility power 3 is delivered from the other end of the external power box 2 to the light-emitting diode lamp 1, thus providing electricity power to the light-emitting diode lamp 1. In addition, the rectifying circuit 14 of the light-emitting diode lamp 1 rectifies the received utility power 3 to provide a rectified power to the light-emitting diode 12.

In particular, the dimming control loop 26 adjusts the output energy to the load (namely, the light-emitting diode 12) according to the adjusted resistor value of the variable resistor (namely, the adjusted conduction angles of the DIAC and the TRIAC). That is, when the variable resistor is adjusted to degrade the brightness of the light-emitting diode 12, the dimming control loop 26 controls and delivers the degraded voltage and current to the output end through the isolated transformer 23, thus reducing the output energy.

In addition, the light-emitting diode lamp 1 does not require any power control circuit because the light-emitting diode lamp 1 has the rectifying circuit 14. Thus, the light-emitting diode lamp 1 does not judge the polarity of the applied power when the utility power 3 is delivered to the light-emitting diode lamp 1 through the external power box 2.

Figure 4B:
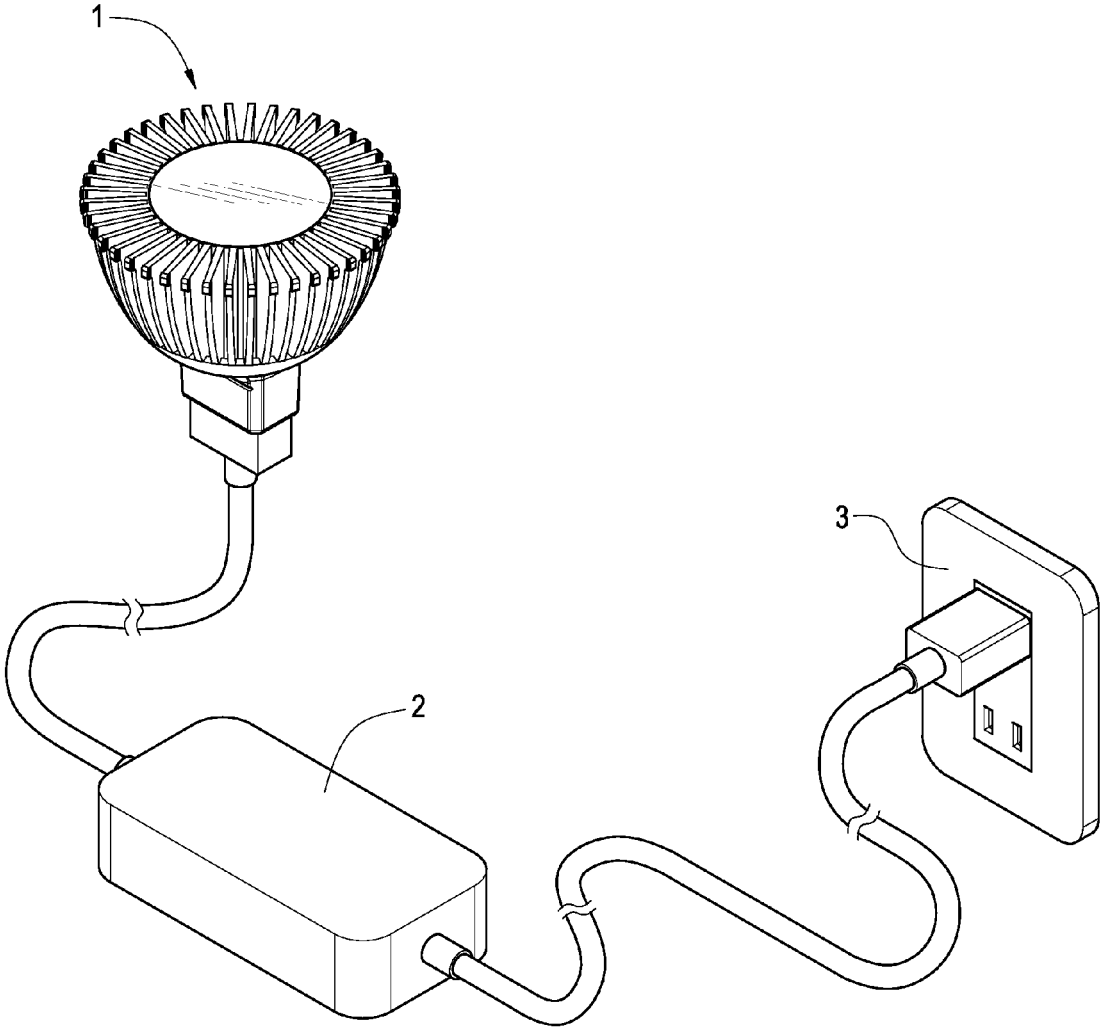
FIG. 4B is a schematic view of another embodiment.

Reference is further made to FIG. 4B which is a schematic view of another embodiment. The dimmer 4 is optional device based on the external electrical-control lamp and the dimmer 4 is whether used according to the user's demand. As shown in FIG. 4B, the utility power 3 is electrically connected to one end of the external power box 2 and the other end of the external power box 2 is electrically connected to the light-emitting diode lamp 1, thus providing electricity power to the light-emitting diode lamp 1. Because the operation of the light-emitting diode lamp 1 is the same as stated above, the detail description is omitted here for conciseness.

Furthermore, the amount of the light-emitting diodes 12 is not limited to only one. Whether the light-emitting diodes 12 are connected in series or in parallel, the external power box 2 can be directly connected to the light-emitting diode lamp 1. The light-emitting diodes 12 can be driven by a high voltage or also a low voltage produced from the external power box 2.

In conclusion, the present invention has following advantages:

1. When the light-emitting diode lamp 1 or the external power box 2 malfunctions, it only needs to replace the light-emitting diode lamp 1 or the external power box 2, that is, it does not need to discard the entire light-emitting diode module. This would avoid waste of the usable components to meet the requirements of environmental protection.

2. The power control circuits are installed in the external power box 2 to effectively reduce the temperature around the electronic components.

3. The interior temperature of the light-emitting diode lamp 1 could effectively decrease because of increasing interior space of the light-emitting diode lamp 1, thus increasing the lifetime and reliability thereof.

4. Because the unrectified power is delivered to the light-emitting diode lamp 1 through the external power box 2, the light-emitting diode lamp 1 can be considered as the non-polarity lamp to increase of use compatibility.

5. Whether the light-emitting diodes 12 are connected in series or in parallel, the external power box 2 can be directly connected to the light-emitting diode lamp 1.

6. The light-emitting diode lamp 1 can be used to substitute the traditional halogen lamp to realize the energy saving.

7. By adjusting the variable resistor of the dimmer 4, the conduction angles of the DIAC and the TRIAC are control to adjust the brightness of the light-emitting diode 12.

8. The light-emitting diodes 12 can be driven by a high voltage or also a low voltage to increase the compatibility of the power supply for the light-emitting diode lamp 1.

Although the present invention has been described with reference to the preferred embodiment thereof, it will be understood that the invention is not limited to the details thereof Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An external electrical-control lamp with improved structure comprising:

a light-emitting diode lamp (1) having:

a circuit board (11);

at least one light-emitting diode (12) installed on the circuit board (11);

a thermal module (13) providing a heat-dissipating function to the light-emitting diode (12); and a rectifying circuit (14) providing a rectified power to the light-emitting diode (12); and an external power box (2) having an AC-to-DC conversion circuit (21), a voltage/current feedback circuit (22), an isolated transformer (23), a constant-current output circuit (24), and a power factor correction circuit (25);

wherein one end of the external power box (2) is electrically connected to the rectifying circuit (14) of the light-emitting diode lamp (1), thus providing electricity power to the light-emitting diode lamp (1).

2. The external electrical-control lamp in claim 1, wherein the rectifying circuit (14) is a bridge diode rectifying circuit.

3. The external electrical-control lamp in claim 1, wherein the light-emitting diode lamp (1) is held on a lamp housing.

4. The external electrical-control lamp in claim 1, wherein the rectifying circuit (14) has a pin (141), and the pin (141) is electrically connected to the external power box (2).

5. The external electrical-control lamp in claim 1, further comprising:

a dimmer (4) electrically connected between the external power box (2) and the utility power (3) to adjust the brightness of the light-emitting diode (12).

6. The external electrical-control lamp in claim 1, wherein the external power box (2) further has a dimming control loop (26).

7. The external electrical-control lamp in claim 1, wherein the other end of the external power box (2) is electrically connected to the dimmer (4).

8. The external electrical-control lamp in claim 5, wherein the dimmer (4) has a phase-control circuit which is composed of a diode AC switch (DIAC),a triode AC semiconductor switch (TRIAC), and a variable resistor.

* * * * *